United States Patent [19]

Oka et al.

[11] Patent Number: 4,912,513

[45] Date of Patent: Mar. 27, 1990

[54] DEVELOPING APPARATUS WITH VARIABLE DEVELOPING BIAS VOLTAGE

[75] Inventors: Tateki Oka; Naoki Toyoshi; Tomoaki Yokoyama, all of Osaka, Japan

[73] Assignee: Minolta Camera Kabushiki Kaisha, Osaka, Japan

[21] Appl. No.: 214,644

[22] Filed: Jul. 1, 1988

[30] Foreign Application Priority Data

Jul. 2, 1987 [JP] Japan ..... 62-167579
Jul. 2, 1987 [JP] Japan ..... 62-167581

[51] Int. Cl.[4] ..... G03G 15/09

[52] U.S. Cl. ..... 355/253; 118/657; 355/265

[58] Field of Search ..... 355/14 D, 3 DD; 118/657, 658

[56] References Cited

U.S. PATENT DOCUMENTS 4,230,070 10/1980 Murasaki et al. ..... 355/3 DD X
4,347,299 8/1982 Ozawa et al. ..... 355/3 DD X
4,378,158 3/1983 Kanbe ..... 355/3 DD
4,432,634 2/1984 Tabuchi ..... 355/14 D
4,733,267 3/1988 Enoki et al. ..... 355/3 DD

FOREIGN PATENT DOCUMENTS 58-217950 12/1983 Japan .
59-113463 6/1984 Japan .
61-80280 4/1986 Japan .
62-283369 12/1987 Japan .
2186818 8/1987 United Kingdom ..... 355/3 DD

*Primary Examiner*—A. T. Grimley
*Assistant Examiner*—Robert Beatty
*Attorney, Agent, or Firm*—Wenderoth, Lind & Ponack

[57] ABSTRACT

A copying apparatus in which a developing bias voltage to be applied to a developing sleeve by a power source is changed to adjust the density of a reproduced image, while the electric potential difference between the developing sleeve and a toner supply roller is kept constant. As a result, a density of toner on the developing sleeve is kept constant. Therefore, a development is effected under the condition in which the density of the toner is constant, so that the tone of the image of an original document is reproduced in a desired density.

8 Claims, 3 Drawing Sheets

DEVELOPING APPARATUS WITH VARIABLE DEVELOPING BIAS VOLTAGE

BACKGROUND OF THE INVENTION

1. Field of the Invention

The present invention relates to a copying apparatus for reproducing an image by an electrographic process.

2. Description of the Related art

These kind of copying apparatuses are provided with a developing unit including a developing sleeve whose outer circumferential face allows the formation of a magnetic brush of developer consisting of magnetized carrier and toner; a toner supply roller which is adjacent to the developing sleeve and supplies a toner thereto; a power source for applying a developing bias voltage to the developing sleeve; and a power source for applying a toner-collecting bias voltage to the toner supply roller so as to develop an electrostatic latent image formed on an electrostatic latent image holding member by the magnetic brush formed on the developing sleeve.

Generally, a copying apparatus adjusts a reproduced image to one of several densities responsive to the tone of the image of an original document. In order to adjust the density of a reproduced image, the following methods are adopted: a developing bias voltage is changed; the gap between the developing sleeve and the photoreceptor drum is adjusted; or the height of a magnetic brush formed on the developing sleeve is regulated.

In the conventional copying apparatus, when the density of a reproduced image is adjusted by changing a developing bias voltage, the electric potential difference between the developing bias voltage applied to the developing sleeve and the toner-collecting bias voltage applied to the toner supply roller is changed, with the result that the amount of toner supplied from the toner supply roller to the developing sleeve is not balanced with the amount of toner collected from the developing sleeve to the toner supply roller, i.e., the density of the toner on the developing sleeve is changed. Thus, the density of the reproduced image is not as desired.

In order to overcome this problem, conventional copying apparatuses are provided with means for adjusting the gap between the developing sleeve and the toner supply roller or the height of developer in the form of a magnetic brush is regulated, but the construction is complicated, and further, it is difficult to control the means.

SUMMARY OF THE INVENTION

Accordingly, an essential object of the present invention is to provide a copying apparatus capable of reproducing the image of an original document in a desired density, even if a developing bias voltage is changed.

In accomplishing this object, there is provided a copying apparatus comprising: a developing unit including a developing sleeve whose outer circumferential face allows the formation of a magnetic brush of developer consisting of magnetized carrier and toner; a toner supply roller which is adjacent to said developing sleeve and supplies toner thereto; a power source for applying a developing bias voltage to said developing sleeve; and a power source for applying a toner-collecting bias voltage to said toner supply roller so as to develop an electrostatic latent image formed on an electrostatic latent image holding member by said magnetic brush formed on said developing sleeve; control means for outputting a plurality of electric potentials to said developing sleeve and said toner supply roller; and selection means for selecting an electric potential from a plurality of the electric potentials.

In another aspect of the present invention, there is provided a copying apparatus comprising: a developing unit including a developing sleeve whose outer circumferential face allows the formation of a magnetic brush of developer consisting of magnetized carrier and toner; a toner supply roller which is adjacent to said developing sleeve and supplies toner thereto; a power source for applying a developing bias voltage to said developing sleeve; and a power source for applying a toner-collecting bias voltage to said toner supply roller so as to develop an electrostatic latent image formed on an electrostatic latent image holding member by said magnetic brush formed on said developing sleeve; and control means for changing the developing bias voltage so as to adjust density of a reproduced image and for changing the toner-collecting voltage so as to maintain constant electric potential difference between said developing sleeve and said toner supply roller.

By the arrangement according to the present invention as described above, when the developing bias voltage is changed to adjust the density of a reproduced image, the toner-collecting bias voltage is changed by the control means, with the result that the electric potential difference between the developing sleeve and the toner supply roller is kept constant, and the amount of toner supplied from the toner supply roller to the developing sleeve is balanced with the amount of toner collected from the developing sleeve to the toner supply roller. Thus, the density of the toner on the developing sleeve becomes constant. Accordingly, under the condition in which the toner density is constant, a development is accomplished according to the electric potential difference between a changed developing bias voltage applied to the developing sleeve and the constant voltage applied to the electrostatic latent image holding member.

As is apparent from the foregoing description, according to the present invention, even though the developing bias voltage to be applied to the developing sleeve is changed to adjust the density of a reproduced image, the electric potential difference between the developing sleeve and the toner supply roller is kept constant. As a result, the density of the toner on the developing sleeve is kept constant. Therefore, a development is effected under a condition in which the density of the toner is constant, so that the tone of the image of an original document is reproduced in a desired density.

BRIEF DESCRIPTION OF THE DRAWINGS

These and other objects and features of the present invention will become apparent from the following description of a preferred embodiment thereof with reference to the accompanying drawings, in which.

DETAILED DESCRIPTION OF THE INVENTION

Figure 1:
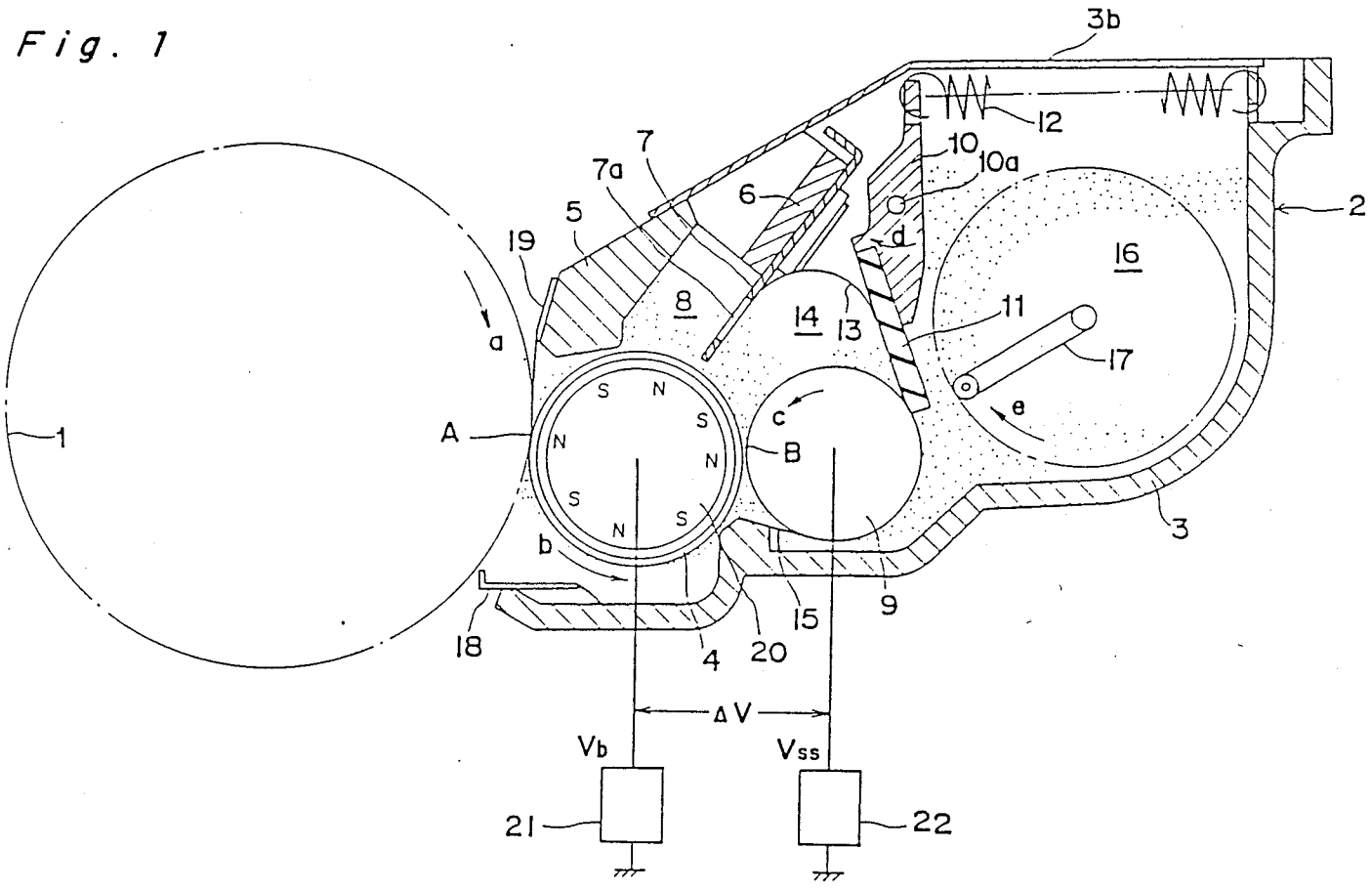
FIG. 1 is a sectional view showing the developing unit of a copying apparatus of the preferred embodiment according to the present invention.

Before the description of the present invention proceeds, it is to be noted that like parts are designated by like reference numerals and symbols throughout the accompanying drawings.

Referring now to the drawings, FIG. 1 illustrates a developing part an electrophotographic copying apparatus according to one preferred embodiment of the present invention. The electrographic copying apparatus comprises a developing unit 2 disposed on one side of a photoreceptor drum 1, rotatable in the direction of arrow a and supplying toner to an electrostatic latent image formed on the photoreceptor drum 1. The developing unit 2 is provided with a developing tank 3 in which a developing sleeve 4 is mounted adjacent to the photoreceptor drum 1. The developing unit 2 is also provided with a toner accommodating tank 16 disposed adjacent to a toner supply roller 9 which supplies the toner accommodated in the toner accommodating tank 16 to the surface of the developing sleeve 4.

A developing bias voltage Vb is applied from a power source 21 to the cylindrical developing sleeve 4 which is composed of conductive non-magnetic material and can be driven to rotate even in a period of time in which a developing operation is not performed. A magnetic roller 20 having negative and positive poles alternately disposed thereon is coaxially fixed to the developing sleeve 4 on the inner circumference thereof. Magnetic developer, consisting of positively charged insulating toner and negatively charged magnetic carrier, is circularly rotated at the same speed as that of the developing sleeve 4 and in the direction in which the developing sleeve 4 rotates in the direction shown by an arrow (b).

A non-magnetic main developer agitating plate 5 fixed to a cover 3*b* is adjacent to the photoreceptor drum 1, and a non-magnetic auxiliary developer agitating plate 7 is fixed to the cover 3*b* through a supporting member 6. The top ends of the main and auxiliary agitating plates 5 and 7 are adjacent to the outer circumferential face of the developing sleeve 4.

The main developer agitating plate 5 regulates the amount of magnetized developer to be transported to a developing region (A) on the circumferential face of the developing sleeve 4, i.e., it prevents part of the magnetized developer from being transported by the developing sleeve 4 in the direction shown by the arrow (b) upstream from the developing region (A). A space 8 is formed between the main developer agitating plate 5 and the upstream auxiliary developer agitating plate 7.

Similarly to the main developer agitating plate 5, the auxiliary developer agitating plate 7 prevents part of the magnetized developer from being transported by the developing sleeve 4 toward the space 8. A space 14 is formed by the auxiliary developer agitating plate 7, the toner supply roller 9, a blade 11, and a developer scatter-preventing film 13. The auxiliary developer agitating plate 7 has a slit 7*a* extending in the axial direction of the developing sleeve 4 and allowing the magnetized developer to pass therethrough. The outer of free ends of the main and auxiliary developer agitating plates 5 and 7 are disposed at approximately midway between adjacent magnetic poles of the magnetic roller 20 which face the main and auxiliary agitating plates 5 and 7.

The toner supply roller 9 composed of conductive non-magnetic material, for example, aluminum is disposed adjacent to the developing sleeve 4. A toner-collecting bias voltage Vss is applied to the toner supply roller 9 from a power source 22. Very shallow recesses of approximately 10 μm are blasted on the surface of the toner supply roller 9. The toner supply roller 9 is rotatable in the direction shown by an arrow (c) in synchronism with the rotation of the developing sleeve 4 and can be driven even in the period of time in which the developing unit 2 is not effecting a development.

A partition wall 10 is disposed to be rotatable about an axis 10*a* above the toner supply roller 9. One end of a spring 12 is secured to one upper end of the developing tank 3. The other end of the spring 12 is secured on the upper portion of the partition wall 10 which is urged in the direction shown by an arrow (d), which causes the lower end of the blade 11 mounted below the partition wall 10 to be brought into contact with the toner supply roller 9 under pressure in the direction in which the toner supply roller 9 rotates. A sealing member 15 is so mounted below the toner supply roller 9 in the developing tank 3 that the sealing member 15 is in contact with the toner supply roller 9 under pressure in the direction in which the toner supply roller 9 rotates.

The developing tank 3 is partitioned into two parts by the partition wall 10, the blade 11, the toner supply roller 9, and the sealing member 15. There is provided in the toner accommodating tank 16 an agitating blade 17 rotatable in the direction shown by an arrow (e). The agitating blade 17 mixes and agitates positively charged insulating toner accommodated in the toner accommodating tank 16.

A toner spill-preventing plate 18 and a toner scatter-preventing film, namely, "Mylar" 19 ("Mylar" is the trademark for polyethylene glycol terephthalate film) are mounted on the developing tank 3 and the cover 3*b* at lower and upper portions of the developing tank 3, respectively so as to face the photoreceptor drum 1 and so as to prevent developer and toner from scattering out of the developing tank 3.

Figure 2:
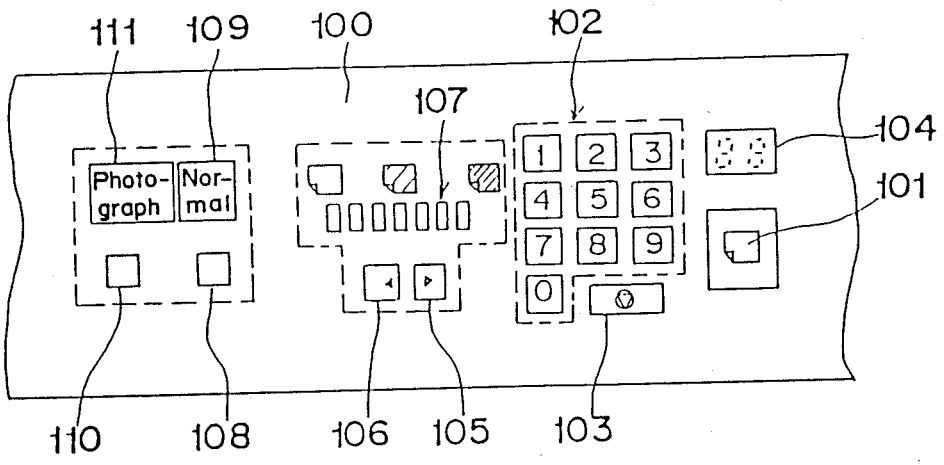
FIG. 2 is a partial plan view of the operation panel of the copying apparatus.

FIG. 2 illustrates an operation panel 100. The panel 100 is provided with a print key 101, a keyboard 102 of ten digit keys, a clear/stop key 103, an indicating portion 104 to indicate the number of sheets to be copied, an image density-up key 105 and an image density-down key 106 for adjusting an image density, an image density-indicating light emitting diode 107 (hereinafter referred to as an image density-indicating LED), a normal copying mode-selection key (line image-copying mode key) 108, a normal copying mode-indicating portion 109 (hereinafter referred to as normal copying mode-indicating LED), a photograph copying mode-selection key 110, and a photograph copying mode-indicating portion 111 (hereinafter referred to as photograph copying mode-indicating LED.) The image density is adjusted by controlling the output of the power source 21 (the developing bias voltage Vb) in this embodiment.

Figure 3:
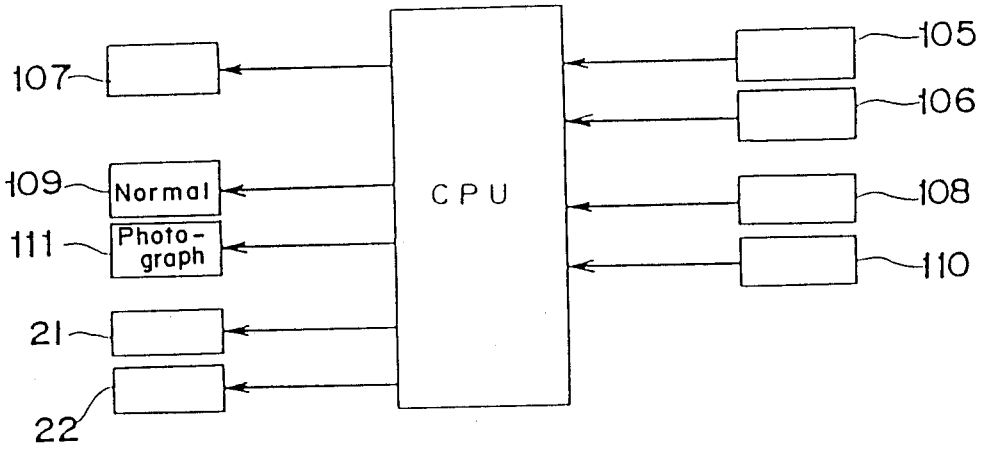
FIG. 3 is a block diagram of the control means of the copying apparatus.

FIG. 3 shows a block diagram of the control means of the copying apparatus according to the embodiment. The copying apparatus is controlled by a microcomputer (CPU). Specifically, a desired image density is adjusted by pressing the image density-up key 105 and the image density-down key 106. A mode (normal or photograph) is selected by pressing a desired one of the normal copying mode-selection key 108 and the photograph copying mode-selection key 110. When data is inputted through these keys, the microcomputer controls the ON or OFF of the image density-indicating LED 107 and the normal copying mode-indicating LED 109 and the photograph copying mode-indicating LED 111 and also the switching from the developing bias voltage Vb to the toner-collecting bias voltage Vss and vice versa which are the outputs of the power sources 21 and 22.

Table 1 shows the developing bias voltages Vb and the toner-collecting bias voltage Vss in this embodiment. The difference between the developing bias voltage Vb and the collecting bias voltage Vss is shown by ΔV, namely the difference between the electric potential of the developing sleeve 4 and that of the toner supply roller 9.

TABLE 1

| Normal Copying Mode | | | |
|---|---|---|---|
| position of LED 107 | Vb(V) | Vss(V) | ΔV(V) |
| 1 | −125 | −265 | 140 |
| 2 | −150 | −290 | 140 |
| 3 | −175 | −315 | 140 |
| 4 | −200 | −340 | 140 |
| 5 | −225 | −365 | 140 |
| 6 | −250 | −390 | 140 |
| 7 | −275 | −415 | 140 |

TABLE 2

| Photograph Copying Mode | | | |
|---|---|---|---|
| position of LED 107 | Vb(V) | Vss(V) | ΔV(V) |
| 1 | −125 | −355 | 230 |
| 2 | −150 | −380 | 230 |
| 3 | −175 | −405 | 230 |
| 4 | −200 | −430 | 230 |
| 5 | −225 | −455 | 230 |
| 6 | −250 | −480 | 230 |
| 7 | −275 | −505 | 230 |

The operation of the developing unit having the above-described construction is described hereinbelow.

First, the space 14 is filled with a starter consisting of negatively charged magnetic carrier and positively charged insulating toner mixed with each other. The space 14 may be filled with only the magnetized carrier instead of the starter. Thereafter, the toner accommodating tank 16 is filled with positively charged insulating toner, which allows the developing unit 2 to develop an electrostatic latent image formed on the photoreceptor drum 1.

The very shallow recesses formed on the surface of the toner supply roller 9 are filled with toner accommodated in the toner accommodating tank 16. While the toner is being transported in the direction shown by the arrow (c) according to the rotation of the toner supply roller 9 in the same direction, surplus toner is scraped off by the blade 11. At this time, toner which has filled the recesses is charged as a result of frictional contacts with the blade 11. When the changed toner has arrived at a position (B) at which the toner supply roller 9 faces the developing sleeve 4, the toner is attracted by the magnetic brush which is formed on the developing sleeve 4 and consists of magnetized carrier, i.e., the toner is supplied from the supply roller 9 to the developing sleeve 4. At this time, surplus toner supplied to the developing sleeve 4 is collected on the toner supply roller 9 by an electrostatic attraction generated according to the electric potential difference ΔV between the developing bias voltage Vb applied to the developing sleeve 4 and the toner-collecting bias voltage Vss applied to the toner supply roller 9. Thus, developer containing toner in such an adjusted amount as to be capable of reproducing the image of an original document is held on the surface of the developing sleeve 4.

The relationship between the density of the toner on the developing sleeve 4 and the electric potential difference ΔV between the developing bias voltage Vb and the toner-collecting bias voltage Vss, and the relationship between a toner density and an image reproduction density are described later.

The toner supplied to the developing sleeve 4 and the carrier held on the developing sleeve 4 are transported in the direction shown by the arrow (b) with the rotation thereof. Most of developer, namely, mixtures of toner and carrier strike against the auxiliary developer-agitating plate 7, and then, are forced upwards along the auxiliary developer-agitating plate 7 by developer which subsequently arrives at the auxiliary developer-agitating plate 7. Thereafter, the developer passes through the slit *7a*, and then is transported downstream to the space 8. Some of developer passes through the gap between the auxiliary developer-agitating plate 7 and the developing sleeve 4, and then, are transported downstream to the space 8.

The downstream transportation of most of developer which has been transported to the space 8 is prevented by the main developer-agitating plate 5, which forces the developer to be transported upwards within the space 8, and then, transported toward the auxiliary developer-agitating plate 7, that is, the developer goes around clockwise within the space 8 to be mixed and agitated. Part of the developer in the space 8 passes through the gap between the main developer-agitating plate 5 and the developing sleeve 4 with their heights regulated by the gap to form magnetic brushes on the developing sleeve 4. The magnetic brush consisting of the developer brushes the photoreceptor drum 1 at the developing region (A). As a result, an electrostatic latent image formed on the surface of the photoreceptor drum 1 is developed into a visual image.

When magnetized developer which has not been used for the development and which remains on the surface of the developing sleeve 4 is transported by the developing sleeve 4 to the portion (B) at which the developing sleeve 4 faces the toner supply roller 9, new toner is supplied there from the toner supply roller 9 to the developing sleeve 4 so as to be used for next development.

The relationship between the electric potential difference ΔV and the toner density and the relationship between the toner density and the image reproduction are described hereinbelow.

Figure 4:
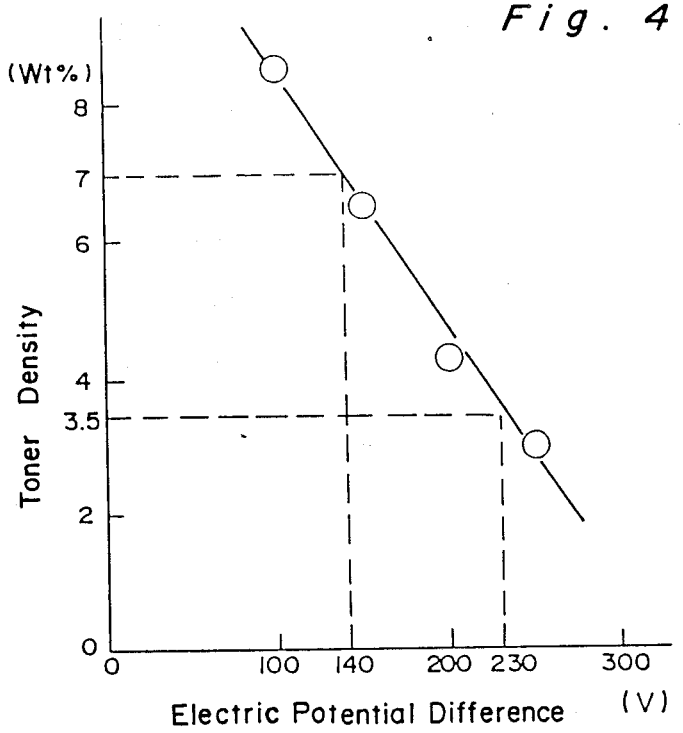
FIG. 4 is a graph showing the change of toner densities with respect to the electric potential difference between a developing sleeve and a toner supply roller.

FIG. 4 shows the change of the density of the toner contained in developer on the developing sleeve 4 according to the change of the electric potential difference ΔV between the developing bias voltage Vb applied to the developing sleeve 4 and the toner-collecting bias voltage Vss applied to the toner supply roller 9.

As shown in FIG. 4, the toner density falls in proportion to the rise of the electric potential difference ΔV and rises in proportion to the fall of the electric potential difference ΔV. When toner is supplied from the toner supply roller 9 to the developing sleeve 4, surplus toner in the form of magnetic brushes is prevented from being transported downstream toward the photoreceptor drum 1 by the main and auxiliary developer-agitating plates 5 and 7, i.e., the control of toner supplied from the toner supply roller 9 onto the developing sleeve 4 is accomplished not by the electric potential difference ΔV but by a mechanical adjustment, whereas toner is collected from the developing sleeve 4 by the toner supply roller 9 by the electrostatic attraction generated by the electric potential difference ΔV between the developing bias voltage Vb applied to the developing sleeve 4 and the toner-collecting bias voltage Vss applied to the toner supply roller 9. That is, the collection of the toner from the developing sleeve 4 by the toner supply roller 9 is determined by the degree of the electrostatic attraction based on the electric potential difference ΔV. When the electric potential difference ΔV is big, the electrostatic attraction becomes strong. As a result, a large amount of the toner is transferred from the developing sleeve 4 onto the toner supply roller 9, i.e., the density of the toner on the developing sleeve 4 becomes low. When the electric potential difference ΔV is small, the electrostatic attraction becomes weak, which causes the amount of the toner to be collected by toner supply roller 9 to become small, i.e., the density of the toner on the developing sleeve 4 becomes high. This is the reason for the rise and fall of the toner density as shown in FIG. 4.

Figure 5:
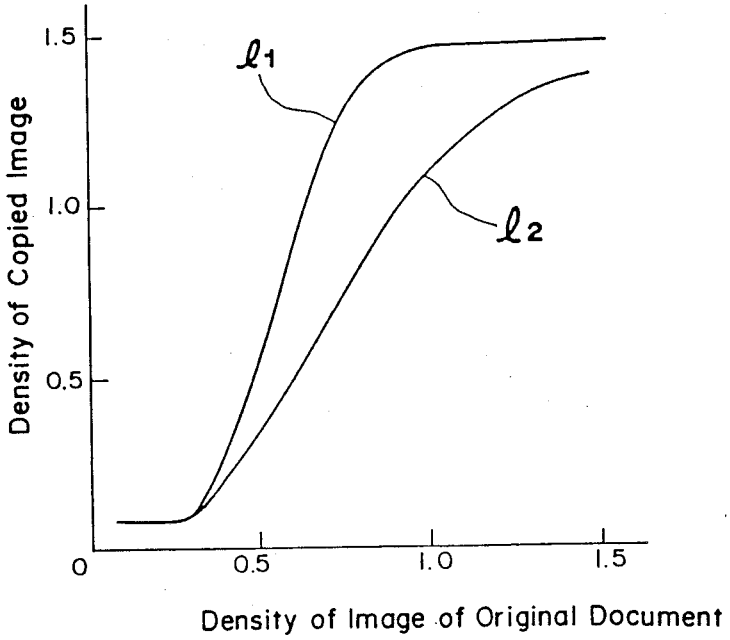
FIG. 5 is a graph showing the change of the density of a copied image relative to the density of the image of an original document.

FIG. 5 shows the image reproduction characteristic of the copying apparatus in terms of the change of the density of a copied image relative to the density of the image of an original document. In FIG. 5, a curve $l_1$ is obtained when the density of the toner on the developing sleeve 4 is 7 wt % (percentage by weight). This curve, having a great gradient, indicates the image reproduction characteristic obtained in copying the line image of an original document, namely, in a normal copying mode. A curve $l_2$ is obtained when the density of the toner on the developing sleeve 4 is 3.5 wt % (percentage by weight). This curve, having a gradient less than that of $l_1$, indicates the image reproduction characteristic obtained in copying a photograph image of the original document.

Next, let it be assumed that the operation mode of the copying apparatus of this embodiment is in the normal copying mode and the image density-indicating LED 107 is positioned at, for example, the normal position "4" and the normal copying mode is switched to the photograph copying mode by pressing the photograph copying mode-selection key 110.

As shown in Table 1, the developing bias voltage Vb and the toner-collecting bias voltage Vss which are the outputs of the power sources 21 and 22, respectively are set to −200V and −340V in the normal copying mode. When the photograph copying mode-selection key 110 is pressed, the photograph copying mode-indicating LED 111 lights and the voltages Vb and Vss are set to −200V and −430V, respectively as shown in Table 2. That is, the electric potential difference ΔV therebetween increases from 140V to 230V.

Consequently, toner is collected from the developing sleeve 4 by the toner supply roller 9 in an amount greater than that in the normal copying mode. Specifically, the density of the toner on the developing sleeve 4 reduces from 7 wt % to 3.5 wt % as shown in FIG. 5. The image reproduction characteristic obtained in the photograph copying mode is represented by the curve $l_2$ having a smaller gradient than the curve $l_1$. That is, the density of the copied image of portion where the density of an original document is low is not varied, whereas the density of the copied image of portion where the density thereof is halftone is low and reproduced in a wide range, i.e, the tone of the image of the original document can be faithfully reproduced. Accordingly, a reproduced image is faithful to that of a photograph.

Experiments prove that the density of all of the toner on the developing sleeve 4 uniformly becomes approximately 3.5 wt % 1∼2 seconds after the electric potential difference ΔV is switched from 140V to 230V. Thus, the change of only the electric potential difference ΔV allows a prompt switching of the density of the toner without consuming toner. Therefore, there is no need to develop electrostatic latent images formed on the photoreceptor drum 1 so as to reduce the toner density by consuming the toner.

The description of the operation of the normal copying mode selected by pressing the normal copying mode-selection key 108 is omitted herein because the opposite operation to the above operation is effected.

The description given hereinbelow is directed to the operation which is to be performed by pressing the image density-up key 105 and the image density-down key 106 when an original document is being copied in the normal copying mode.

The microcomputer (CPU) decides which of the densities has been selected according to how many times the image density-up key 105 and the image density-down key 106 are pressed and lights the image density-indicating LED 107 at the position corresponding to the selected density. For example, if the image density-up key 105 is pressed twice when the image density-indicating LED 107 indicates "4", the LED at the position of "6" lights. The developing bias voltage Vb and the toner-collecting bias voltage Vss are set to −250V and −390V, respectively from −200V and −340V as shown in Table 1.

The density of a copied image falls because of the increase of the developing bias voltage Vb from −200V to −250V. The density of the toner on the developing sleeve 4 is not changed because the electric potential difference ΔV is kept constant. This is because with the increase of the developing bias voltage Vb, the toner-collecting bias voltage Vss increases and, consequently, the difference ΔV maintains a constant value. Accordingly, in the normal copying mode, the density of a copied image is as selected by operating the image density-up key 105 and the image density-down key 106.

Let it be assumed that the developing bias voltage Vb changes and that the toner-collecting bias voltage Vss does not change by the operation of the image density-up key 105 and the image density-down key 106.

For example, if the image density-indicating LED 107 positioned at "4" is switched to the image density-indicating LED 107 positioned at "7" by pressing the image density-up key 105, the developing bias voltage changes from −200V to −275. At this time, the toner-collecting bias voltage remains −340V. As a result, the electric potential difference ΔV reduces from 140V to 65V. As shown in FIG. 4, the toner density increases from 7 wt % to 9.5 wt %. Therefore, even though the image density-up key 105 is pressed to lower the density of a copied image, the toner density is equal or becomes higher than that. Thus, the image of an original document is not reproduced in a desired density.

If the image density-indicating LED 107 positioned at "4" is switched to the image density-indicating LED 107 positioned at "1" by pressing the image density-down key 106, the developing bias voltage Vb changes from −200V to −125V. At this time, the toner-collecting voltage remains −340V. As a result, the electric potential difference ΔV increases from 140V to 215V. As shown in FIG. 4, the toner density is reduced from 7 wt % to 4 wt %. Accordingly, even though the image density down-key 106 is pressed to increase the density of a reproduced image, the toner density is equal or becomes lower than that. Thus, the image of an original document is not reproduced in a desired density.

However, as described above, in this embodiment, the toner-collecting bias voltage Vss is changed with the change of the developing bias voltage Vb, so that the electric potential ΔV becomes constant. Therefore, the density of the toner is kept constant and such a problem as described above does not occur.

In this embodiment, an alternating voltage may be superimposed on the toner-collecting bias voltage Vss.

As is apparent from the foregoing description, a mode in which the electric potential difference between the developing sleeve and the toner supply roller is large and a mode in which the electric potential difference between the developing sleeve and the toner supply roller is small are selectively provided. Accordingly, a simple operation of switching the electric potential difference by setting the developing bias voltage or the toner-collecting bias voltage to a predetermined voltage reproduces the tone of the image of an original document in a desired degree.

As apparent from the foregoing description, according to the embodiment, even though the developing bias voltage to be applied to the developing sleeve is changed to adjust the density of a reproduced image, the electric potential difference between the developing sleeve and the toner supply roller is kept constant. As a result, the density of the toner on the developing sleeve is kept constant. Therefore, a development is effected under a condition in which the density of the toner is constant, so that the tone of the image of an original document is reproduced in a desired density.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus comprising:

a developing unit including a developing sleeve having an outer circumferential surface on which is formed a magnetic brush of developer consisting of magnetized carrier and toner;

a toner supply roller adjacent to said developing sleeve for supplying toner thereto;

a first power source connected to said developing sleeve for applying a developing bias voltage to said developing sleeve;

a second power source connected to said toner supply roller for applying a toner-collecting bias voltage to said toner supply roller so as to develop an electrostatic latent image formed on an electrostatic latent image holding member by said magnetic brush formed on said developing sleeve; and control means connected to said first and second power sources for changing the developing bias voltage so as to adjust the density of a reproduced image and for changing the toner-collecting bias voltage so as to maintain a constant electric potential difference between said developing sleeve and said toner supply roller.

2. A copying apparatus as claimed in claim 1, wherein said second power source includes means for superimposing an alternating voltage on said toner supply roller.

3. A copying apparatus as claimed in claim 1, wherein said second power source includes means for supplying a toner-collecting bias voltage which has the same polarity as that of the developing bias voltage and is larger than the developing bias voltage so as to collect the toner on said developing sleeve to said toner supply roller by electrostatic attraction based on the electric potential difference.

4. A copying apparatus as claimed in claim 1, wherein a blade and a sealing member are positioned around said toner supply roller with the blade and the sealing member forming a partition between a toner tank for accommodating the toner and a space formed around said toner supply roller in the developing unit.

5. A copying apparatus comprising:

a developing unit including a developing sleeve having an outer circumferential surface on which is formed a magnetic brush of developer consisting of magnetized carrier and toner;

a toner supply roller adjacent to said developing sleeve for supplying toner thereto;

a first power source connected to said developing sleeve for applying a developing bias voltage to said developing sleeve;

a second power source connected to said toner supply roller for applying a toner-collecting bias voltage to said toner supply roller so as to develop an electrostatic latent image formed on an electrostatic latent image holding member by said magnetic brush formed on said developing sleeve;

a mode selection means for selecting an electrostatic potential difference from a plurality of preset electric potential differences between said developing sleeve and said toner supply roller; and a control means connected to said first and second power sources and to which said mode selection means is connected for changing the developing bias voltage so as to adjust the density of a reproduced image and for changing the toner-collecting bias voltage so as to maintain a constant electric potential difference therebetween as selected by said mode selection means.

6. A copying apparatus as claimed in claim 5, wherein said second power source includes means for superimposing an alternating voltage on said toner supply roller.

7. A copying apparatus as claimed in claim 5, wherein said second power source includes means for supplying a toner-collecting bias voltage which has the same polarity as that of the developing bias voltage and is larger than the developing bias voltage so as to collect the toner on said developing sleeve to said toner supply roller by an electrostatic attraction based on the electric potential difference.

8. A copying apparatus as claimed in claim 5, wherein a blade and a sealing member are positioned around said toner supply roller with the blade and the sealing member forming a partition between a toner tank for accommodating the toner and a space formed around said toner supply roller in the developing unit.

* * * * *